US007280021B2

(12) United States Patent
Nagasaki

(10) Patent No.: US 7,280,021 B2
(45) Date of Patent: Oct. 9, 2007

(54) LINEAR SOLENOID DESIGNED TO ENSURE REQUIRED AMOUNT OF MAGNETIC ATTRACTION AND SOLENOID VALVE USING SAME

(75) Inventor: Kanehisa Nagasaki, Ichinomiya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 51 days.

(21) Appl. No.: 11/187,901

(22) Filed: Jul. 25, 2005

(65) Prior Publication Data

US 2006/0017535 A1 Jan. 26, 2006

(30) Foreign Application Priority Data

Jul. 26, 2004 (JP) ..... 2004-217296

(51) Int. Cl.
*H01F 3/00* (2006.01)
*H01F 7/08* (2006.01)

(52) U.S. Cl. ..... 335/255; 335/227; 335/261; 335/279; 335/281

(58) Field of Classification Search ..... 335/227, 335/255, 258, 261–264, 273, 279, 281; 251/129.08, 251/129.15, 129.18
See application file for complete search history.

(56) References Cited

U.S. PATENT DOCUMENTS 3,054,935 A * 9/1962 Fisher et al. ..... 335/261
3,577,107 A * 5/1971 Widl et al. ..... 335/248
3,860,894 A * 1/1975 Popovic et al. ..... 335/258
4,583,067 A * 4/1986 Hara ..... 335/261
RE32,860 E * 2/1989 Clark ..... 335/261
5,066,980 A * 11/1991 Schweizer ..... 335/255
5,687,698 A * 11/1997 Mastro et al. ..... 123/568.26
6,076,550 A * 6/2000 Hiraishi et al. ..... 137/550
6,615,780 B1 * 9/2003 Lin et al. ..... 123/90.17
6,731,191 B2 * 5/2004 Lang et al. ..... 335/255
6,827,331 B1 * 12/2004 Roos ..... 251/129.15

FOREIGN PATENT DOCUMENTS

JP 5-164263 6/1993
JP 2000-230660 8/2000
JP 2004-301294 10/2004

* cited by examiner

*Primary Examiner*—Ramon M. Barrera
(74) *Attorney, Agent, or Firm*—Nixon & Vanderhye P.C.

(57) ABSTRACT

A linear solenoid is provided which works to pull a plunger to a stator magnetically. The plunger and the stator are aligned to have ends opposed to each other. The end of the stator has formed therein a recess into which the end of the plunger is insertable. The recess has an inward magnetic attraction surface formed on a peripheral edge. The plunger has an outward magnetic attraction surface formed on an outer peripheral edge of the end thereof which faces the inward magnetic attraction surface through a magnetic gap. The inward and outward magnetic attraction surfaces have greater areas defining the magnetic gap, thereby ensuring a greater amount of magnetic attraction pulling the plunger to the stator upon energization of a coil. The recess may alternatively be formed in the end of the plunger.

11 Claims, 7 Drawing Sheets

FIG. 4
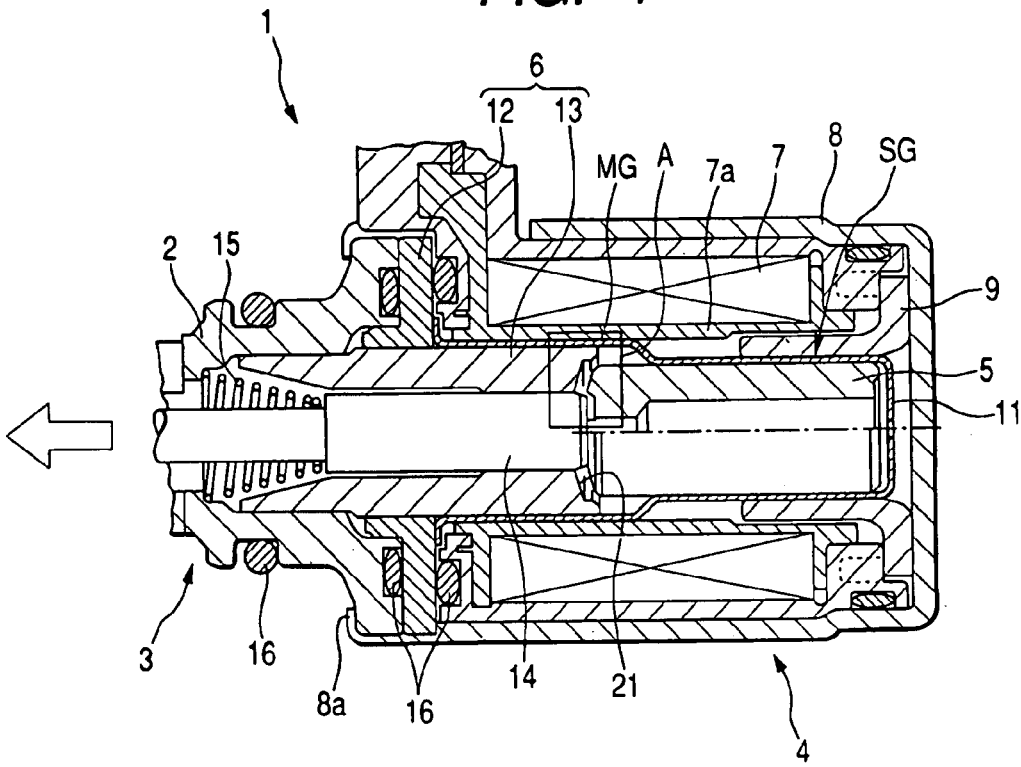
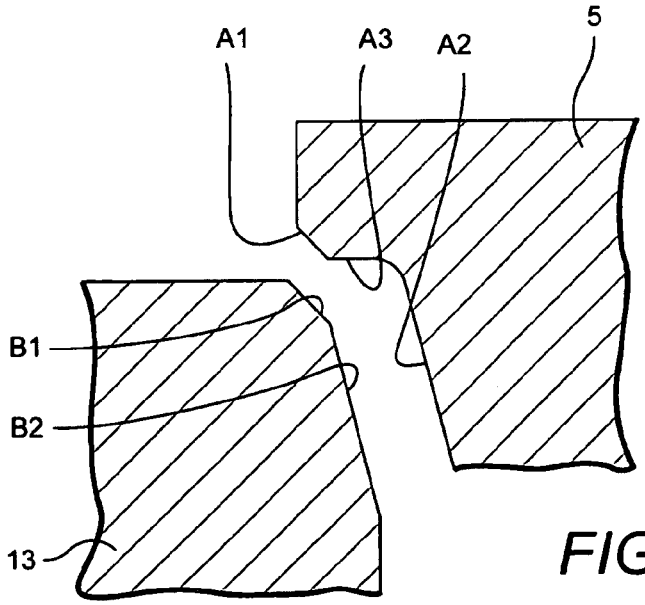
FIG. 9

LINEAR SOLENOID DESIGNED TO ENSURE REQUIRED AMOUNT OF MAGNETIC ATTRACTION AND SOLENOID VALVE USING SAME

CROSS REFERENCE TO RELATED DOCUMENT

The present application claims the benefit of Japanese Patent Application No. 2004-217296 filed on Jul. 26, 2004, the disclosure of which is incorporated herein by reference.

BACKGROUND OF THE INVENTION

1. Technical Field of the Invention

The present invention relates generally to a linear solenoid working to move a plunger linearly through a magnetic attraction and a solenoid-operated valve designed to move a valve body using such a linear solenoid.

2. Background Art

A typical example of conventional linear solenoids will be described below with reference to FIGS. 5(*a*) to 7(*b*).

The linear solenoid is designed to pull a plunger to a stator linearly through a magnetic attraction produced by energization of a coil. The plunger is constantly subjected directly or indirectly to a return pressure as produced by a spring. For example, Japanese Patent First Publication No. 2000-230660 discloses such a type of linear solenoid.

The linear solenoid has a magnetically attracting structure which is typically of one of three types: flat, tapered, and magnetic saturation.

The flat type is, as illustrated in FIG. 6(*a*), made up of the stator J1 and the plunger J2 having flat surfaces facing each other in an axial direction thereof.

The tapered type is, as illustrated in FIG. 7(*a*), made up of the stator J1 and the plunger J2 having tapered or curved surfaces opposed in an axial direction thereof in order to increase a magnetically attracting area of the stator J1.

The magnetic saturation type has the structure, as illustrated in FIG. 8(*a*), in which the stator J1 has formed in an end thereof a recess J3 into which the plunger J2 is insertable without any physical contact therewith and also has an outer peripheral edge J4 tapered to produce a variable magnetic resistance to a stroke of the plunger J2, and the plunger J2 has an outer peripheral edge J5 tapered to produce a magnetic gap changing with a change in stroke of the plunger J2.

In operation of the flat type of liner solenoid, as shown in FIG. 6(*a*), when the magnetic gap between the stator J1 and the plunger J2 in the axial direction thereof is small, it will produce a greater magnetic attraction acting on the plunger J2 in the axial direction. The magnitude of the magnetic attraction is, as illustrated in FIG. 6(*b*), substantially inversely proportional to a square of distance between the stator J1 and the plunger J2. Thus, when the magnetic gap between the stator J1 and the plunger J2 is great, it will result in a greatly decreased magnetic attraction acting on the plunger J2. The flat type, therefore, has a difficulty in producing a greater stroke of the plunger J2.

Usually, the magnitude of the magnetic attraction increases hyperbolically with a decrease in the magnetic gap between the stator J1 and the plunger J2. Therefore, when the magnetic gap decreases, it may produce an excessive magnetic attraction which gives rise to physical deformation or deterioration such as wear of operating parts of the solenoid. In order to avoid this, it is necessary to set the magnetic gap great when the plunger J2 reaches the end of the stroke thereof. This, however, results in a difficulty in decreasing the size of the coil in order to ensure a desired amount of magnetic attraction when the plunger J2 starts to move.

In operation of the tapered type of linear solenoid, as shown in FIG. 7(*a*), when the magnetic gap between the stator J1 and the plunger J2 in the axial direction thereof is small, it will produce a magnetic attraction acting on the plunger J2 in the axial direction which is greater than that produced by the flat type of linear solenoid because the curved surfaces are formed on the opposed ends of the stator J1 and the plunger J2. However, when the magnetic gap between the stator J1 and the plunger J2 is great, it will, like the flat type, result in a greatly decreased magnetic attraction acting on the plunger J2. The tapered type, therefore, has also a difficulty in producing a greater stroke of the plunger J2.

Like the flat type, the magnitude of the magnetic attraction increases, as illustrated in FIG. 7(*b*), hyperbolically with a decrease in the magnetic gap between the stator J1 and the plunger J2. Therefore, when the magnetic gap decreases, it may produce an excessive magnetic attraction which gives rise to physical deformation or deterioration such as wear of operating parts of the solenoid. In order to avoid this, it is necessary to set the magnetic gap great when the plunger J2 reaches the end of the stroke thereof. This, however, results in a difficulty in decreasing the size of the coil in order to ensure a desired amount of magnetic attraction when the plunger J2 starts to move.

In operation of the magnetic saturation type of linear solenoid, as shown in FIG. 8(*a*), when the plunger J2 enters the recess J3 of the stator J1, it will produce a magnetic flux oriented in a radius direction of the stator J1, thereby reducing a change in the magnetic attraction acting in the axial direction of the plunger J1 with a change in stroke of the plunger J2 and permitting an effective stroke of the plunger J2 to be increased. The outer tapered edges J4 and J5 work to produce a constant change in magnetic attraction acting on the plunger J2 in the axial direction thereof with a change in stroke of the plunger J2.

However, when the plunger J2 starts to move, in other words, when the magnetic gap between the plunger J2 and the stator J1 is great, the magnetic attraction acting on the plunger J2 in the axial direction thereof is small because of small areas of the opposed ends of the stator J1 and the plunger J2.

Additionally, when the plunger J2 reaches the end of the stroke thereof, that is, when the magnetic gap between the plunger J2 and the stator J1 is small, the areas of the opposed ends of the stator J1 and the plunger J2 are small, so that the magnetic attraction acting on the plunger J2 in the axial direction thereof will be small. Specifically, the magnetic saturation type of linear solenoid has a difficulty in producing a great amount of magnetic attraction directed in the axial direction of the plunger J2 during a duration between the start and end of the stroke of the plunger J2. This results in a difficulty in decreasing the size of the coil of the solenoid.

A broken line R in FIGS. 6(*b*), 7(*b*), and 8(*b*), indicates a return pressure (e.g., the load of a return spring) acting on the plunger J2. An arrow I in FIGS. 6(*b*) and 7(*b*) indicates an allowable range of the magnitude of magnetic attraction required to ensure the durability of operating parts of the solenoid. A hatched area in FIGS. 6(*b*) to 8(*b*) indicates the performance of the solenoid. The greater the hatched area is, the more excellent the performance is.

SUMMARY OF THE INVENTION

It is therefore a principal object of the invention to avoid the disadvantages of the prior art.

It is another object of the invention to provide a linear solenoid which is designed to produce a required amount of magnetic attraction during a duration between start to end of movement of a linearly movable member of the solenoid, in other words, which is allowed to be decreased in size thereof and a solenoid-operated valve using the same.

According to one aspect of the invention, there is provided a linear solenoid which may be employed in a hydraulic controller of an automatic transmission for automotive vehicles to feed or draw oil to or from a hydraulic actuator which works to hydraulically establish engagement or disengagement of frictional elements of a multiple disc clutch or a multiple disc brake of the transmission or in a hydraulic controller of a variable valve timing (VVT) system to feed or draw oil to or from an advance angle chamber or a retard angle chamber of a hydraulic actuator for controlling the advance angle of a cam shaft of the engine.

The linear solenoid comprises: (a) a coil working to produce a magnetic attraction when energized; (b) a plunger made of a magnetic material having a length, the plunger being disposed to be slidable linearly in a lengthwise direction of the plunger; (c) a stator disposed to have an end facing an end of the plunger, the stator working to transmit the magnetic attraction, as produced by the coil, to the end thereof to pull the plunger to the stator, the end of the stator having a peripheral surface and a recess formed inward of the peripheral surface into which the end of the plunger enters without any contact with the stator; (d) a first inward magnetic attraction surface formed on a peripheral edge of the recess of the stator, the first inward magnetic attraction surface being inclined to an axis of the stator so as to face an axis of the plunger; and (e) a first outward magnetic attraction surface formed on an outer peripheral edge of the end of the plunger. The first outward magnetic attraction surface is inclined to an axis of the plunger to be opposed to the first inward magnetic attraction surface through a first magnetic gap within which the magnetic attraction appears which works to pulls the first outward magnetic attraction surface to the first inward magnetic attraction surface. The first outward magnetic attraction surface is located closer to a bottom of the recess of the stator than the first inward magnetic attraction surface when the plunger is in a given stroke position. With these arrangements, the first inward magnetic attraction surface of the stator and the first outward magnetic attraction surface of the plunger are located close to each other when the coil is energized to move the plunger, thereby ensuring an amount of axial magnetic attraction required to move the plunger upon energization of the coil. This permits the coil to be made compact and lightweight.

In the preferred mode of the invention, each of the first inward magnetic attraction surface and the first outward magnetic attraction surface may be formed to extend at a given angle to a line with which the plunger and the stator aligned to have the ends of the plunger and the stator face each other.

The linear solenoid further comprises a second inward magnetic attraction surface formed on the bottom of the recess of the stator and a second outward magnetic attraction surface formed on the end of the plunger inwardly of the first outward magnetic attraction surface. The second inward magnetic attraction surface is inclined to the axis of the stator. The second outward magnetic attraction surface is inclined to the axis of the plunger so as to face the second inward magnetic attraction surface through a second magnetic gap within which a magnetic attraction appears which works to pulls the second outward magnetic attraction surface to the second inward magnetic attraction surface. Specifically, areas of the second inward and outward magnetic attraction surfaces opposed to the second magnetic gap are relatively great, thereby ensuring a greater amount of magnetic attraction to pull the plunger to the stator.

Each of the second inward magnetic attraction surface and the second outward magnetic attraction surface extends at a given angle to a line with which the plunger and the stator aligned to have the ends of the plunger and the stator face each other.

The recess has an inner wall surface formed inward of the first inward magnetic attraction surface. The inner wall surface extends substantially parallel to the axis of the stator or at an acute angle to the axis of the stator.

The recess may alternatively be formed in the end of the plunger so that the end of the stator may enter the recess of the plunger as the plunger is pulled magnetically.

According to another aspect of the invention, there is provided a solenoid-operated valve which comprises: (1) a valve device including fluid paths and a valve disposed to be movable to switch the fluid paths, close the fluid path selectively, or control flow areas of the fluid paths; and (2) a linear solenoid. The linear solenoid includes (a) a coil working to produce a magnetic attraction when energized, (b) a plunger made of a magnetic material having a length, the plunger being disposed to be slidable linearly in a lengthwise direction of the plunger to move the valve, (c) a stator disposed to have an end facing an end of the plunger, the stator working to transmit the magnetic attraction, as produced by the coil, to the end thereof to pull the plunger to the stator, (d) a recess formed in the end of one of the stator and the plunger inwardly of a peripheral surface of the end into which the other of the stator and the plunger enters without any contact therewith, (e) a first inward magnetic attraction surface formed on a peripheral edge of the recess, the first inward magnetic attraction surface being inclined to an axis of the one of the stator and the plunger so as to face an axis of the other of the stator and the plunger; and (f) a first outward magnetic attraction surface formed on an outer peripheral edge of the end of the other of the stator and the plunger. The first outward magnetic attraction surface is inclined to an axis of the other of the stator and the plunger to be opposed to the first inward magnetic attraction surface through a first magnetic gap within which the magnetic attraction appears which works to pulls the plunger to the stator. The first outward magnetic attraction surface is located closer to a bottom of the recess than the first inward magnetic attraction surface when the plunger is in a given stroke position.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 1(*b*) is a partially enlarged view which shows a stator and a plunger of a linear solenoid of the invention when the plunger is in an intermediate stroke position;

FIG. 1(*c*) is a partially enlarged view which shows modified forms of a stator and a plunger of a linear solenoid;

FIG. 4 is a partially longitudinal sectional view which shows a solenoid hydraulic control valve equipped with a linear solenoid of the invention;

FIG. 5(*b*) is a partially longitudinal sectional view which shows a second modification of a solenoid hydraulic control valve in which the linear solenoid, as illustrated in FIG. 4, may be installed;

FIG. 6(*b*) is a graph which shows a relation between the stroke of the plunger of the linear solenoid of FIG. 5(*a*) and the magnitude of magnetic attraction as produced by the solenoid;

FIG. 7(*b*) is a graph which shows a relation between the stroke of the plunger of the linear solenoid of FIG. 6(*a*) and the magnitude of magnetic attraction as produced by the solenoid;

FIG. 8(*b*) is a graph which shows a relation between the stroke of the plunger of the linear solenoid of FIG. 7(*a*) and the magnitude of magnetic attraction as produced by the solenoid; and FIG. 9 is similar to FIGS. 1(*a*)-(*c*) but having reversed shapes with respect to stator and movable plunger portions.

DESCRIPTION OF THE PREFERRED EMBODIMENTS

Figure 1A:
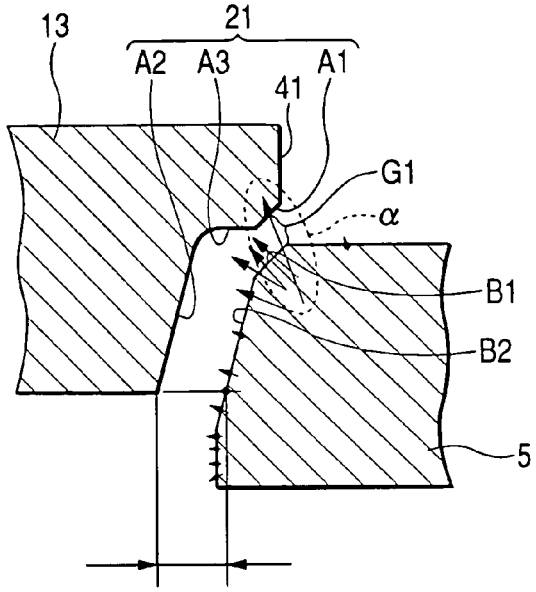
FIG. 1(*a*) is a partially enlarged view which shows a stator and a plunger of a linear solenoid of the invention when the plunger starts to move.
Figure 1B:
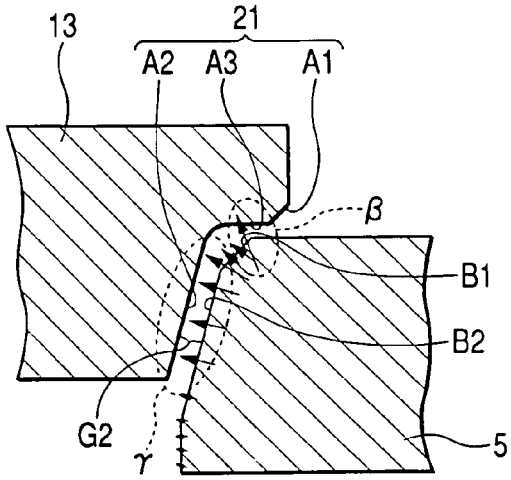
Figure 1C:
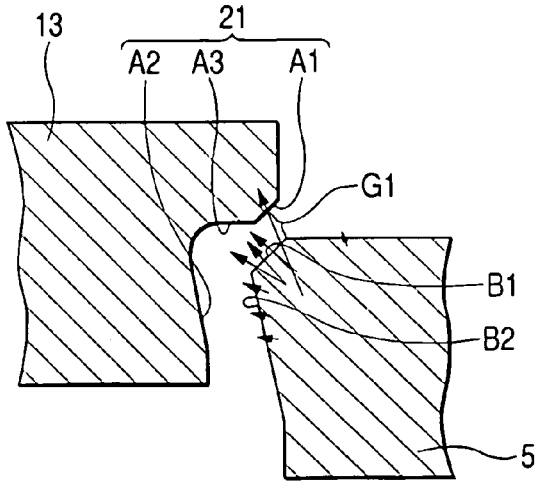

Referring to the drawings, wherein like reference numbers refer to like parts in several views, particularly to FIGS. 1(*a*) to 4, there is shown a solenoid hydraulic control valve 1 that is typical of a solenoid-operated valve and made by a combination of a valve device and a linear solenoid according to the invention.

The solenoid hydraulic control valve 1 may be installed in a hydraulic controller of an automatic transmission for automotive vehicles to feed or draw oil to or from a hydraulic actuator which works to hydraulically establish engagement or disengagement of frictional elements of a multiple disc clutch or a multiple disc brake of the transmission or in a hydraulic controller of a variable valve timing (VVT) system to feed or draw oil to or from an advance angle chamber or a retard angle chamber of a hydraulic actuator for controlling the advance angle of a cam shaft of the engine.

FIG. 4 illustrates highlights of the solenoid hydraulic control valve 1. The solenoid hydraulic control valve 1 includes a valve housing 2, a valve assembly 3 equipped with a valve (not shown), and a linear solenoid 4 working to move the valve linearly in an axial direction of the control valve 1.

The valve housing 2 is made of a hollow cylinder and has formed therein an oil inlet/outlet port (not shown) through which oil is fed into or drawn from the housing 2.

The valve of the valve assembly 3 is designed to be slidable within the housing 2 in the axial direction of the housing 2 and may be either of a spool or a ball type. In the case of the spool type, the valve has a land (i.e., a large-diameter portion) which has an outer diameter substantially identical with an inner diameter of the housing 2. The land is moved in the axial direction of the housing 2 to switch between fluid paths leading to the oil inlet/outlet port, close the fluid path selectively, or control an open area of the fluid path. In the case of the ball type, the valve is slidable in the axial direction of the housing 2 to open or close the fluid path within the valve housing 2.

The linear solenoid 4 is equipped with a plunger 5, a stator assembly 6, a coil 7, a yoke 8, a side gap core 9, and a connector (not shown). The plunger 5 is made of a magnetic metal, such as iron (i.e., a ferromagnetic material forming a portion of a magnetic circuit), which is magnetically pulled by the stator assembly 6. The plunger 5 is retained inside the coil 7 (i.e., an oil sealing cup guide 11) to be slidable in the lengthwise direction thereof.

The stator assembly 6 consists of a disc plate 12 and a cylindrical stator 13. The disc plate 12 is disposed between the valve housing 2 and the coil 7. The stator 13 works to transmit the magnetic flux produced by the plate 12 to near the plunger 5. The plate 12 and the stator 13 are each made of a magnetic metal, such as iron (i.e., a ferromagnetic material forming a portion of the magnetic circuit). A main gap MG (i.e., a magnetic attraction gap), which will be described later in detail, is formed between the plunger 5 and the stator 13. The plate 12 and the stator 13 may alternatively be formed by a one-piece member.

When energized, the coil 7 works to produce a magnetic attraction which pulls the plunger 5 to the stator assembly 6. The coil 7 is made of turns of enamel wire wound around a resinous bobbin 7*a*.

The yoke 8 is made of a magnetic metal, such as iron (i.e., a ferromagnetic material forming a portion of the magnetic circuit), and surrounds the coil 7. The yoke 8 is joined to the housing 2 by crimping claws 8*a* formed on an end thereof.

The side gap core 9 surrounds the periphery of the plunger 5 through a side gap SG and works to establish transmission of the magnetic flux between itself and the plunger 5 through the side gap SG. The yoke 8 and the side gap core 9 may alternatively made of a one-piece member.

The connector makes an electrical connection of the solenoid hydraulic control valve 1 with a valve controller (not shown). The connector has installed therein terminals joined to ends of the coil 7.

The solenoid hydraulic control valve 1 also includes a shaft 14 and a coil spring 15. The shaft 14 works to transmit axial movement of the plunger 5 to the valve. The shaft 14 is placed in abutment of a right end, as viewed in the drawing, with the plunger 5, however, may be press fit in the plunger 5. The shaft 14 has a left end which is press fit within the valve or formed integrally therewith. The shaft 14 may alternatively be placed in abutment with the valve if the valve is urged toward the plunger 5 by a spring or hydraulic reaction.

The shaft 14 is retained in the center of the stator 13, however, may be held partially using a resinous collar.

The spring 15 is disposed around the shaft 14 within the valve housing 2 and works to urge the shaft 14 right to move the plunger 5 away from the shaft 14, so that the main gap MG increases. The spring 15 may alternatively be disposed between the stator 13 and the plunger 5 or between the valve and the valve housing 2 to exert a return pressure on the valve, the shaft 14, and the plunger 5. If the hydraulic pressure is available which urges the plunger 5, the spring 15 may be omitted.

When the coil 7 is in an off-state, the valve and the plunger 5 are urged by the spring 15 in the right direction, as viewed in the drawing, and held stationary. In this state, the main gap MG is maximized to fix the position of the valve relative to the valve housing 2.

Numeral 16 denotes a sealing O-ring.

In operation of the solenoid hydraulic control valve 1, when the coil 7 of the linear solenoid 4 is energized, it produces the magnetic attraction within the main gap MG. A component of the magnetic attraction oriented in the axial direction of the linear solenoid 4 (which will also be referred to as an axial magnetic attraction below) works to attract the plunger 5 to the stator 13.

The stator 13, as clearly illustrated in FIG. 1(*a*), has an end which has an annular peripheral surface 41 and a circular recess 21 formed inward of the peripheral surface 41 into which an end of the plunger 5 enters without any physical contact with the stator 13. The recess 21 is geometrically designed so that the amount of overlap between the plunger 5 and the stator 13 in the axial direction thereof increases as the plunger 5 enters the recess 21.

The geometrical shapes of ends of the stator 13 and the plunger 5 facing each other through the main gap MG will be described below with reference to FIGS. 1(*a*) to 3. FIGS. 1(*a*), 1(*b*), and 1(*c*) are partially enlarged views which show a portion of the solenoid hydraulic control valve 1, as indicated by A in FIG. 4.

The shape of the recess 21 of the stator 13 will first be discussed below.

The recess 21 has three inner surfaces: a first inward magnetic attraction surface A1, a second inward magnetic attraction surface A2, and an inner peripheral wall surface A3.

Figure 3:
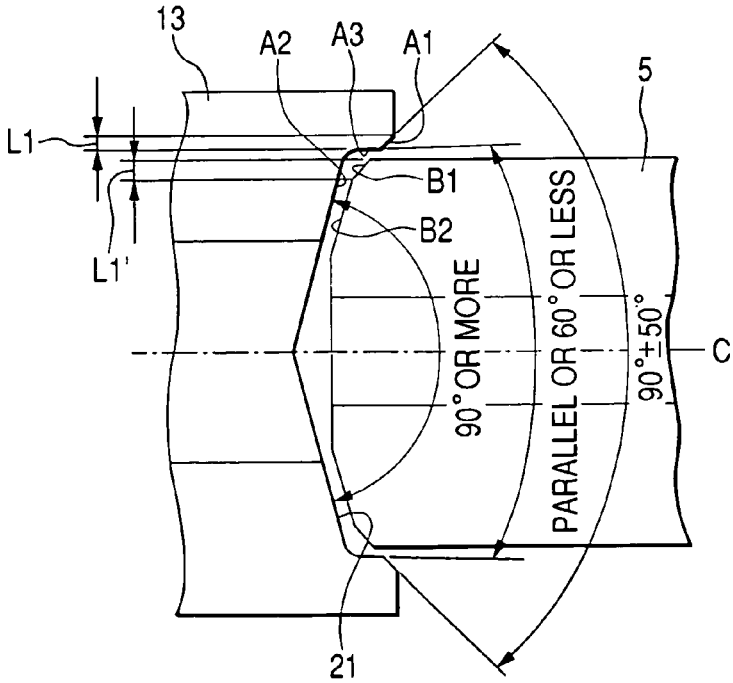
FIG. 3 is a partially enlarged view which shows geometrical shapes of opposed ends of a stator and a plunger of a linear solenoid.

The first inward magnetic attraction surface A1 is formed on a peripheral edge of the recess 21 continuing from the peripheral surface 41 and extends diagonally to the axis (i.e., a longitudinal center line) of the stator 13. The first inward magnetic attraction surface Al is defined by a conical annular surface extending around a longitudinal center line C of an assembly of the stator 13 and the plunger 5 (i.e., a line with which the stator 13 and the plunger 5 aligned), as illustrated in FIG. 3, at a constant angle to the longitudinal center line C which is selected from a range of 90°±50°. The first inward magnetic attraction surface A1 is greater in size than a typical chamfered edge (having a width of 0.1 mm or less in a radius direction of the stator 13) formed in the purpose of removing burrs and has preferably a radius width L1 of 0.1 to 2 mm or 20% to 120% of a stroke of the plunger 5.

The second inward magnetic attraction surface A2 is formed on the bottom of the recess 21 and directed inwardly and diagonally to the axis of the stator 13 (i.e., the longitudinal center line C). The second inward magnetic attraction surface A2 is defined by a conical annular surface extending around the longitudinal center line C at a constant obtuse angle to the longitudinal center line C which is greater than or equal to 90°. The second inward magnetic attraction surface A2 may be defined by an annular surface extending perpendicular to the longitudinal center line C or, as illustrated in FIG. 1(*c*), a conical annular surface tapering toward the right end of the stator 13, as viewed in the drawing.

The inner peripheral wall surface A3 is formed on an inner cylindrical side wall of the recess 21 between the first inward magnetic attraction surface A1 and the second inward magnetic attraction surface A2. The inner peripheral wall surface A3 is defined by an annular surface extending parallel to or at a constant acute angle to the longitudinal center line C which is preferably selected from a range of 60° or less.

Next, the shape of the end of the plunger 5 to be pulled into the recess 21 of the stator 13 will be discussed below.

The end of the plunger 5 has two outer surfaces: a first outward magnetic attraction surface B1 and a second outward magnetic attraction surface B2.

The first outward magnetic attraction surface B1 is formed on an outer peripheral edge of the plunger 5 and directed outwardly and diagonally to the axis (i.e., a longitudinal center line) of the plunger 5. The first outward magnetic attraction surface B1 is defined by an annular conical surface which extends substantially parallel to the first inward magnetic attraction surface A1 of the recess 21 of the stator 13, in other words, which extends at substantially the same angle to the longitudinal center line C of the assembly of the stator 13 and the plunger 5 as that of the first inward magnetic attraction surface A1 which is selected from a range of 90°±50°. The first outward magnetic attraction surface B1 is greater in size than a typical chamfered edge (having a width of 0.1 mm or less in a radius direction of the plunger 5) formed in the purpose of removing burrs and has, as shown in FIG. 3, a radius width L1' of 0.1 to 2 mm or 20% to 120% of a stroke of the plunger 5, like the first inward magnetic attraction surface A1.

The second outward magnetic attraction surface B2 is formed inwardly of the first outward magnetic attraction surface B1 and directed outwardly and diagonally to the axis of the plunger 5. The second outward magnetic attraction surface B2 is defined by a conical annular surface which extends substantially parallel to the second inward magnetic attraction surface A2 of the recess 21 of the stator 13, in other words, which extends at substantially the same obtuse angle to the longitudinal center line C as that of the second inward magnetic attraction surface A2.

When the coil 7 of the linear solenoid 4 is de-energized or in an off-state, the plunger 5 is, as illustrated in FIG. 1(*a*), at rest at a maximum stroke. The magnetic gap between the plunger 5 and the stator 13 in the axial direction thereof is, thus, maximized, while the first inward magnetic attraction surface A1 is close to the first outward magnetic attraction surface B1 through a first magnetic gap G1. This causes a great amount of magnetic attraction (i.e., the axial magnetic attraction) working to pull the plunger 5 in the axial direction thereof, as indicated by magnetic vectors $\alpha$ in FIG. 1(*a*), to appear in the first magnetic gap G1 immediately after the energization of the coil 7. The magnitude of such a magnetic attraction is represented by F1 in FIG. 2.

During an interval from the start to end of a stroke of the plunger 5, the amount of overlap between the plunger 5 and the recess 21 of the stator 13 increases with advancement of the plunger 5, so that the magnetic flux oriented in the radius direction of the plunger 5 increases, as indicated by magnetic vectors $\beta$ in FIG. 1(*b*). This prevents the axial magnetic attraction from increasing hyperbolically as the plunger 5 approaches the end of the stroke thereof, thereby resulting in a substantially constant change in the axial magnetic attraction, as indicated between F1 and F2 in FIG. 2, with a change in the stroke of the plunger 5.

Between the bottom of the recess 21 and a portion of the end of the plunger 5 located inwardly of the first outward magnetic attraction surface B1, a second magnetic gap G2 is produced in which an axial magnetic attraction appears. The magnetic flux in the radius direction of the plunger 5 increases, as described above, as the amount of overlap between the plunger 5 and the recess 21 in the axial direction of the plunger 5 increases, thus resulting in a decrease in the axial magnetic attraction in the second magnetic gap G2.

In order to alleviate the above problem, areas of the recess 21 and the plunger 5 undergoing the axial magnetic attraction within the second magnetic gap G2 are increased by forming the second inward magnetic attraction surface A2 on the bottom of the recess 21 and the second outward magnetic attraction surface B2 inward of the first outward magnetic attraction surface B1 of the plunger 5. This causes a great amount of axial magnetic attraction to be produced within the second magnetic gap G2, as indicated by magnetic vectors γ in FIG. 1(*b*), as the plunger 5 approaches the stator 13, which cancels the decrease in the axial magnetic attraction arising from the increase in the magnetic flux in the radius direction of the plunger 5. The magnitude of the axial magnetic attraction when the plunger 5 has reached the end of the stroke is represented by F2 in FIG. 2.

Figure 2:
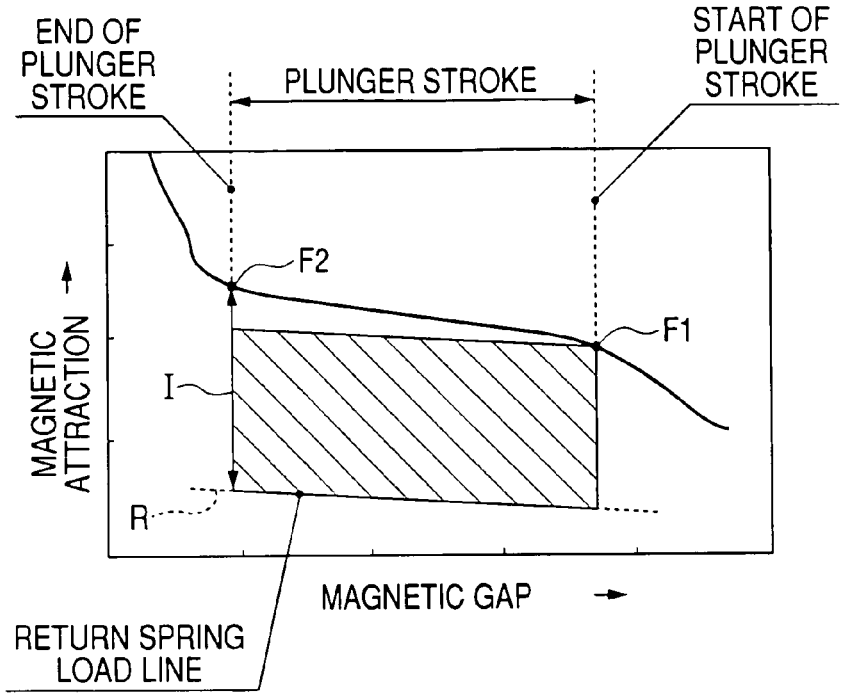
FIG. 2 is a graph which shows a relation between a stroke of a plunger of a linear solenoid and the magnitude of magnetic attraction as produced by the solenoid.

A broken line R in FIG. 2 indicates a return pressure (e.g., the load of a return spring) acting on the plunger 5. An arrow I(=F2) indicates an allowable range of the magnitude of magnetic attraction required to ensure the durability of operating parts of the linear solenoid 4. A hatched area represents the performance of the linear solenoid 4. The greater the hatched area is, the more excellent the performance is.

As apparent from the above discussion, the linear solenoid 4 has the structure in which the first inward magnetic attraction surface A1 is formed on the inner peripheral edge of the recess 21 of the stator 13, and the first outward magnetic attraction surface B1 is formed on the outer peripheral edge of the plunger 5, so that the first inward magnetic attraction surface Al and the first outward magnetic attraction surface B1 are opposed close to each other at the start of the stroke of the plunger 5, thereby producing a greater amount of axial magnetic attraction in the first magnetic gap G1, as indicated by F1 in FIG. 2.

The linear solenoid 4 is of the magnetic saturation type, as described in the introductory part of this application, in which the stator 13 has the recess 21 into which the end of the plunger 5 is inserted without any contact with the stator 13, thereby permitting the stroke of the plunger 5 to be increased, as can be seen from F1 and F2 in FIG. 2, and also minimizing a change in the axial magnetic attraction with a change in the stroke of the plunger 5.

The second inward magnetic attraction surface A2 and the second outward magnetic attraction surface B2 are formed on the bottom of the recess 21 and inward of the first outward magnetic attraction surface B1 of the plunger 5, respectively, to increase the areas of the stator 13 and the plunger 5 undergoing the axial magnetic attraction within the second magnetic gap G2, so that the axial magnetic attraction increases as the plunger 5 approaches the recess 21, thereby avoiding a reduction in the axial magnetic attraction, as indicated by F2 in FIG. 2, when the overlap between the plunger 5 and the recess 21 is increasing.

Specifically, the linear solenoid 4 is designed to ensure a great amount of axial magnetic attraction during a duration between the start and the end of the stroke of the plunger 5, thus permitting the size of the coil 7 to be decreased, which, in turn, permits the linear solenoid 4 to be made compact and lightweight.

The linear solenoid 4 may be employed not only in the solenoid hydraulic control valve 1 designed to turn on or off the coil 7, but also in solenoid hydraulic control valves of the type which change a drive current to be supplied to the coil 7 continuously or stepwise through PWM current control to control the pressure or amount of fluid.

Figure 5A:
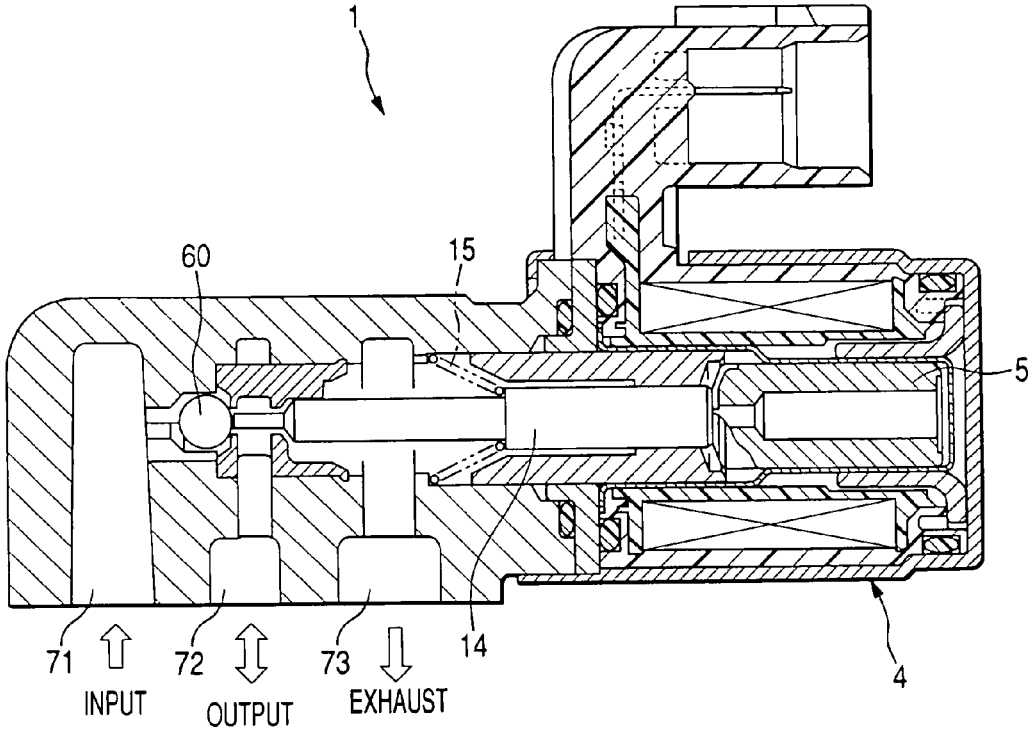
FIG. 5(*a*) is a partially longitudinal sectional view which shows a first modification of a solenoid hydraulic control valve in which the linear solenoid, as illustrated in FIG. 4, may be installed.
Figure 5B:
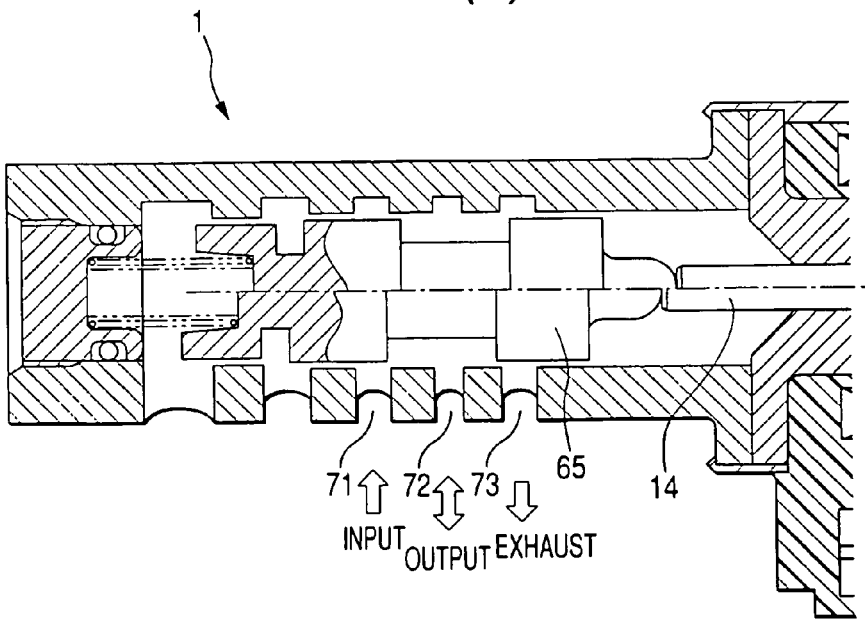
Figure 6B:
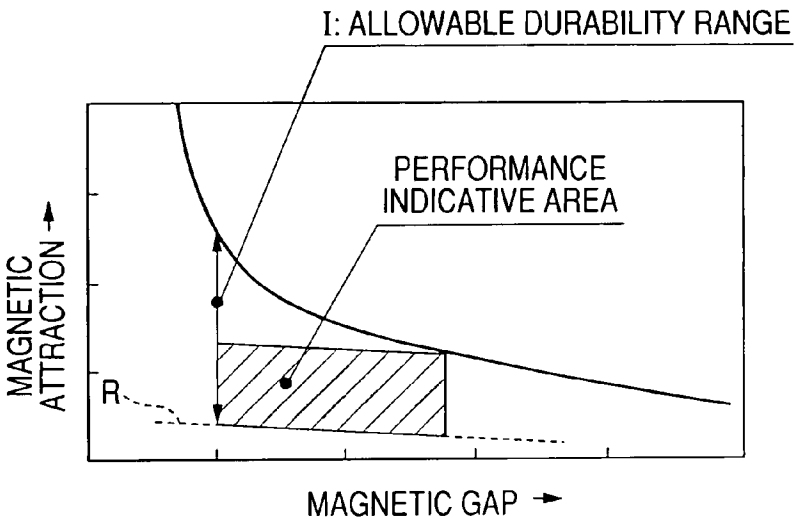
FIG. 6(b) (PRIOR ART)
FIG. 6(*a*) is a partially sectional view which shows a stator and a plunger of a conventional flat type of linear solenoid.
Figure 6A:
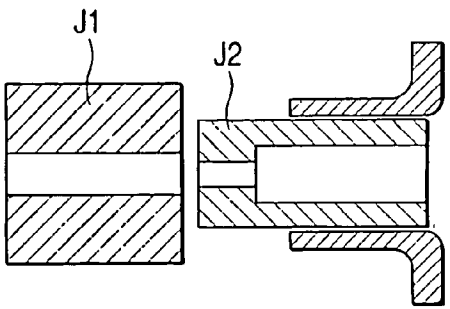
FIG. 6(a) (PRIOR ART)
Figure 7B:
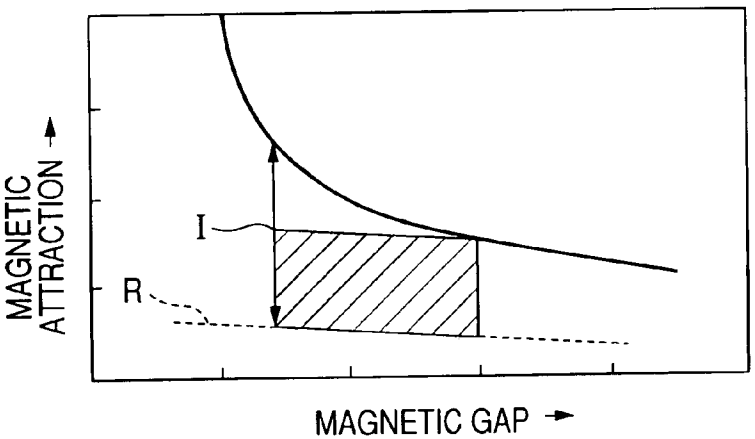
FIG. 7(b) (PRIOR ART)
FIG. 7(*a*) is a partially sectional view which shows a stator and a plunger of a conventional tapered type of linear solenoid.
Figure 7A:
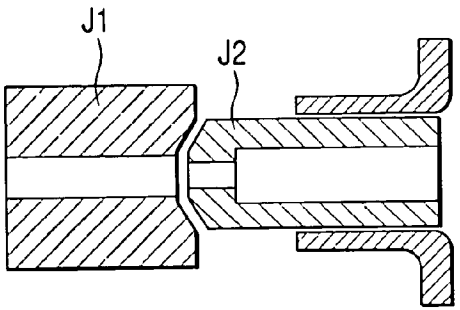
FIG. 7(a) (PRIOR ART)
Figure 8B:
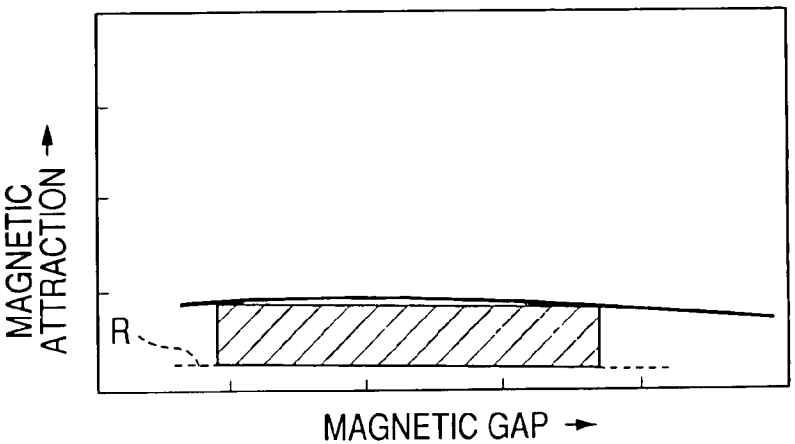
FIG. 8(b) (PRIOR ART)
FIG. 8(*a*) is a partially sectional view which shows a stator and a plunger of a conventional magnetic saturation type of linear solenoid.
Figure 8A:
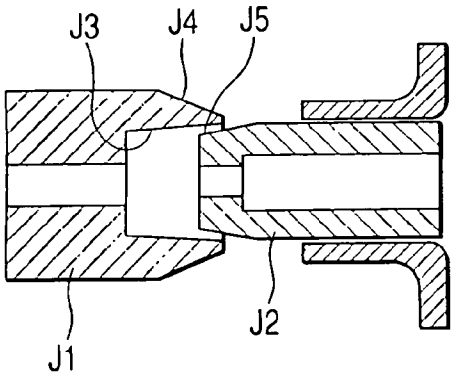
FIG. 8(a) (PRIOR ART)

FIG. 5(*a*) illustrates the solenoid hydraulic control valve 1 of a ball type in which the linear solenoid 4 may be installed. A ball 60 is joined to the shaft 14 to be moved by the linear solenoid 4. When the linear solenoid 4 is de-energized, the ball 60 is in a position, as illustrated. Specifically, the ball 60 blocks a flow of fluid from an inlet 71 to an outlet 72, while establishing fluid communication between the outlet 72 and an exhaust port 73. Alternatively, when the linear solenoid 4 is energized, the shaft 14 is moved left, as viewed in the drawing, to establish fluid communication between the inlet 71 and the outlet 72, while blocking the fluid communication between the outlet 72 and the exhaust port 73.

FIG. 5(*b*) illustrates the solenoid hydraulic control valve 1 of a spool in which the linear solenoid 4 may be installed. A spool 65 is joined to the shaft 14 to be moved by the linear solenoid 4 (not shown in FIG. 5(*b*)). When the linear solenoid 4 is de-energized, the spool 65 is placed in a position, as illustrated at an upper side of FIG. 5(*b*). Specifically, the spool 65 blocks a flow of fluid from an inlet 71 to an outlet 72, while establishing fluid communication between the outlet 72 and an exhaust port 73. Alternatively, when the linear solenoid 4 is energized, the shaft 14 moves the spool 65 left, as illustrated at a lower side of the FIG. 5(*b*), to change an area of the inlet 71 leading to the outlet 72. Specifically, the flow rate of fluid flowing from the inlet 71 to the outlet 72 is controlled by changing the degree of energization of the linear solenoid 5 to change the amount of stroke of the shaft 14 (i.e., the spool 65).

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, the first inward magnetic attraction surface A1 of the recess 21 of the stator 13 may be curved smoothly or formed to have a plurality of fine steps.

Similarly, each of the second inward magnetic attraction surface A2 and the third inward magnetic attraction surface A3 may be curved smoothly or formed to have a plurality of fine steps.

The first inward magnetic attraction surface Al and the third inward magnetic attraction surface A3 may be defined by a single gentle curve. Similarly, the second inward magnetic attraction surface A2 and the third inward magnetic attraction surface A3 may be defined by a single gentle curve.

The first, second, and third inward magnetic attraction surfaces A1, A2, and A3 may be defined by a single smooth curve.

Each of the first and second outward magnetic attraction surface B1 and B2 of the plunger 5 may be curved smoothly or formed to have a plurality of fine steps.

The first and second outward magnetic attraction surface B1 and B2 may be defined by a single smooth curve.

The recess 21 may alternatively be formed in the end of the plunger 5 to allow the end of the stator 13 to enter it without any contact with the plunger 5 as depicted in FIG. 9. In this case, the first, second, and third inward magnetic attraction surfaces A1, A2, and A3 are formed on the end of the plunger 5, while the first and second outward magnetic attraction surfaces B1 and B2 are formed on the end of the stator 13.

The linear solenoid 4 works to move the plunger 5 to the valve assembly 3 upon turning on of the coil 7, however, may be designed to pull the plunger 5 away from the valve assembly 3 to move the valve in a reverse direction upon the turning on of the coil 7.

The linear solenoid 4 may also be employed in a solenoid-operated valve designed to switch between different types of fluids (e.g., water, air, and exhaust gasses of an automotive engine) to be supplied to a fluid circuit, allow or block flow of fluid, or control a flow rate of fluid.

The linear solenoid 4 may also be used as a linear actuator designed to move a movable object other than the valve.

What is claimed is:

1. A linear solenoid comprising:

a coil working to produce a magnetic attraction when energized;

a plunger made of a magnetic material having a length, said plunger being disposed to be slidable linearly in a lengthwise direction of said plunger;

a stator disposed to have an end facing an end of said plunger, said stator working to transmit the magnetic attraction, as produced by said coil, to the end thereof to pull said plunger to said stator, the end of said stator having a peripheral surface and a recess formed inward of the peripheral surface into which the end of said plunger enters without any contact with said stator;

a first inward magnetic attraction surface formed on a peripheral edge of the recess of said stator, said first inward magnetic attraction surface being inclined to an axis of said stator so as to face an axis of said plunger; and a first outward magnetic attraction surface formed on an outer peripheral edge of the end of said plunger, said first outward magnetic attraction surface being inclined to an axis of said plunger to be opposed to said first inward magnetic attraction surface through a first magnetic gap within which the magnetic attraction appears which works to pull said first outward magnetic attraction surface to said first inward magnetic attraction surface, said first outward magnetic attraction surface being located closer to a bottom of the recess of said stator than said first inward magnetic attraction surface when said plunger is in a given stroke position.

2. A linear solenoid as set forth in claim 1, wherein each of said first inward magnetic attraction surface and said first outward magnetic attraction surface extends at a given angle to a line with which said plunger and said stator align to have the ends of said plunger and said stator face each other.

3. A linear solenoid as set forth in claim 1, further comprising a second inward magnetic attraction surface formed on the bottom of the recess of said stator and a second outward magnetic attraction surface formed on the end of said plunger inwardly of said first outward magnetic attraction surface, said second inward magnetic attraction surface being inclined to the axis of said stator, said second outward magnetic attraction surface being inclined to the axis of said plunger so as to face said second inward magnetic attraction surface through a second magnetic gap within which a magnetic attraction appears which works to pull said second outward magnetic attraction surface to said second inward magnetic attraction surface.

4. A liner solenoid as set forth in claim 3, wherein each of said second inward magnetic attraction surface and said second outward magnetic attraction surface extends at a given angle to a line with which said plunger and said stator align to have the ends of said plunger and said stator face each other.

5. A linear solenoid as set forth in claim 1, wherein the recess has an inner wall surface formed inward of said first inward magnetic attraction surface, the inner wall surface extending substantially parallel to the axis of said stator or at an acute angle to the axis of said stator.

6. A linear solenoid comprising:

a coil working to produce a magnetic attraction when energized;

a stator disposed to have an end to which the magnetic attraction, as produced by said coil, is transmitted;

a plunger made of a magnetic material having a length, said plunger being disposed to be slidable linearly in a lengthwise direction of said plunger when said plunger undergoes the magnetic attraction from the end of said stator, said plunger having an end which has a peripheral surface and a recess formed inward of the peripheral surface into which the end of said stator enters without any contact with said plunger;

a first inward magnetic attraction surface formed on a peripheral edge of the recess of said plunger, said first inward magnetic attraction surface being inclined to an axis of said plunger so as to face an axis of said stator; and a first outward magnetic attraction surface formed on an outer peripheral edge of the end of said stator, said first outward magnetic attraction surface being inclined to an axis of said stator to be opposed to said first inward magnetic attraction surface through a first magnetic gap within which the magnetic attraction appears which works to pull said first outward magnetic attraction surface to said first inward magnetic attraction surface, said first outward magnetic attraction surface being located closer to a bottom of the recess of said plunger than said first inward magnetic attraction surface when said plunger is in a given stroke position.

7. A linear solenoid as set forth in claim 6, wherein each of said first inward magnetic attraction surface and said first outward magnetic attraction surface extends at a given angle to a line with which said plunger and said stator align to have the ends of said plunger and said stator face each other.

8. A linear solenoid as set forth in claim 6, further comprising a second inward magnetic attraction surface formed on the bottom of the recess of said plunger and a second outward magnetic attraction surface formed on the end of said stator inwardly of said first outward magnetic attraction surface, said second inward magnetic attraction surface being inclined to the axis of said plunger, said second outward magnetic attraction surface being inclined to the axis of said stator so as to face said second inward magnetic attraction surface through a second magnetic gap within which the magnetic attraction appears which works to pull said second outward magnetic attraction surface to said second inward magnetic attraction surface.

9. A linear solenoid as set forth in claim 8, wherein each of said second inward magnetic attraction surface and said second outward magnetic attraction surface extends at a given angle to a line with which said plunger and said stator align to have the ends of said plunger and said stator face each other.

10. A linear solenoid as set forth in claim 6, wherein the recess has an inner wall surface formed inward of said first inward magnetic attraction surface, the inner wall surface extending substantially parallel to the axis of said plunger or at an acute angle to the axis of said plunger.

11. A solenoid-operated valve comprising:

a valve device including fluid paths and a valve disposed to be movable to switch said fluid paths, close said fluid path selectively, or control flow areas of said fluid paths; and a linear solenoid including, (a) a coil working to produce a magnetic attraction when energized, (b) a plunger made of a magnetic material having a length, said plunger being disposed to be slidable linearly in a lengthwise direction of said plunger to move said valve, (c) a stator disposed to have an end facing an end of said plunger, said stator working to transmit the magnetic attraction, as produced by said coil, to the end thereof to pull said plunger to said stator, (d) a recess formed in the end of one of said stator and said plunger inwardly of a peripheral surface of the end into which the other of said stator and said plunger enters without any contact therewith, (e) a first inward magnetic attraction surface formed on a peripheral edge of said recess, said first inward magnetic attraction surface being inclined to an axis of the one of said stator and said plunger so as to face an axis of the other of said stator and said plunger; and (f) a first outward magnetic attraction surface formed on an outer peripheral edge of the end of the other of said stator and said plunger, said first outward magnetic attraction surface being inclined to an axis of the other of said stator and said plunger to be opposed to said first inward magnetic attraction surface through a first magnetic gap within which the magnetic attraction appears which works to pull said plunger to said stator, said first outward magnetic attraction surface being located closer to a bottom of the recess than said first inward magnetic attraction surface when said plunger is in a given stroke position.

* * * * *